US012345440B2

(12) United States Patent
Faris

(10) Patent No.: US 12,345,440 B2
(45) Date of Patent: Jul. 1, 2025

(54) COMPACT AIR PLENUM SILENCER

(71) Applicant: Nailor Industries of Texas, Inc., Houston, TX (US)

(72) Inventor: Eugene William Michael Faris, Kingwood, TX (US)

(73) Assignee: Nailor Industries of Texas, Inc., Houston, TX (US)

( * ) Notice: Subject to any disclaimer, the term of this patent is extended or adjusted under 35 U.S.C. 154(b) by 201 days.

(21) Appl. No.: 17/978,827

(22) Filed: Nov. 1, 2022

(65) Prior Publication Data

US 2023/0133780 A1 May 4, 2023

Related U.S. Application Data

(60) Provisional application No. 63/263,380, filed on Nov. 1, 2021.

(51) Int. Cl.
*F24F 13/24* (2006.01)

(52) U.S. Cl.
CPC ..... *F24F 13/24* (2013.01); *F24F 2013/242* (2013.01)

(58) Field of Classification Search
CPC ..... F24F 13/24; F24F 2013/242
USPC ..... 181/224
See application file for complete search history.

(56) References Cited

U.S. PATENT DOCUMENTS 2,270,825 A * 1/1942 Parkinson ..... G10K 11/161 73/147
2,916,101 A * 12/1959 Naman ..... G10K 11/172 181/224
4,266,602 A * 5/1981 White ..... H01F 27/33 165/DIG. 313
4,316,522 A * 2/1982 Hirschorn ..... F02M 35/1216 181/252
5,332,872 A * 7/1994 Ewanek ..... F04D 29/663 181/258
5,473,123 A * 12/1995 Yazici ..... F24F 7/08 181/224

(Continued)

FOREIGN PATENT DOCUMENTS

AT 391755 B * 11/1990
EP 3147582 A1 * 3/2017

(Continued)

OTHER PUBLICATIONS

English translation of KR 100718305 B1, accessed Aug. 1, 2024 via Espacenet, <https://translationportal.epo.org/emtp/translate/?ACTION=description-retrieval&COUNTRY=KR&ENGINE=google&FORMAT=docdb&KIND=B1&LOCALE=en_EP&NUMBER=100718305&SRCLANG=ko&TRGLANG=en> (Year: 2007).*

*Primary Examiner* — Jeremy A Luks
(74) *Attorney, Agent, or Firm* — Kilpatrick Townsend & Stockton LLP

(57) ABSTRACT

An apparatus for reducing sound levels in an HVAC system, the apparatus including a housing configured to be positioned within an air inlet vent for an HVAC system. The housing includes a first opening configured to intake air and a second opening configured to out put air and a plurality of baffles positioned within said housing, each baffle including a body defining a volume and has a plurality of perforations, wherein each baffle is affixed to the housing and wherein the plurality of perforations are configured to allow airflow through the volume of the body and redirecting sound waves.

19 Claims, 6 Drawing Sheets

(56) References Cited

U.S. PATENT DOCUMENTS

| | | | | |
|---|---|---|---|---|
| 6,342,005 | B1 * | 1/2002 | Daniels | F24F 13/24 454/906 |
| 7,258,196 | B2 * | 8/2007 | Radatus | F24F 13/24 181/271 |
| 7,581,619 | B1 * | 9/2009 | Storm | F24F 13/20 454/262 |
| 8,087,492 | B2 | 1/2012 | Cursetjee et al. | |
| 9,791,166 | B2 * | 10/2017 | Rainey | F24F 13/24 |
| 10,309,302 | B2 | 6/2019 | Wilhelm et al. | |
| 10,508,828 | B2 * | 12/2019 | Jeong | F24F 13/0263 |
| 2002/0050418 | A1 * | 5/2002 | Jenvey | F24F 13/0281 181/224 |
| 2017/0276397 | A1 * | 9/2017 | Mouratidis | F24F 13/08 |
| 2021/0389023 | A1 * | 12/2021 | Salunkke | G10K 11/161 |
| 2023/0204253 | A1 * | 6/2023 | Bauch | F24F 13/24 181/224 |

FOREIGN PATENT DOCUMENTS

| | | | |
|---|---|---|---|
| KR | 200382863 | Y1 * | 4/2005 |
| KR | 100718305 | B1 * | 5/2007 |
| KR | 924372 | B1 * | 10/2009 |
| KR | 100924958 | B1 * | 11/2009 |
| KR | 101302862 | B1 * | 9/2013 |
| KR | 102101173 | B1 * | 4/2020 |

* cited by examiner

COMPACT AIR PLENUM SILENCER

CROSS-REFERENCE TO RELATED APPLICATIONS

This application claims the benefit of U.S. Provisional Application 63/263,380, filed on Nov. 1, 2021, the entire contents of which is incorporated herein in its entirety.

TECHNICAL FIELD

The present disclosure relates generally to heating, ventilation, and air-conditioning (HVAC) systems. In particular, a compact air plenum silencer for an HVAC system is disclosed.

BACKGROUND

HVAC systems are used to acclimatize the interior environment in closed spaces occupied by persons, such as in buildings and rooms. HVAC systems typically include an air handler to provide circulating air that is used to condition the interior climate of the buildings or rooms. The air handler may include various elements such as heat transfer elements, air filters, humidifiers, air blowers, dampers, and other devices. HVAC systems are typically designed for a specified performance rating, such as for providing a specified volumetric flow of air within the closed spaces.

In particular, the air handler may include a fan inlet cone, a fan unit and a discharge plenum. The fan unit in the air handler may include an inlet cone, a fan, a motor, a fan frame, and other control elements associated with the fan. One important design aspect of an HVAC system design is the management of noise and vibrations that components in the air handler may generate, including noise from the fan units, blower motors, ducts, air control dampers, and air outlets, among other noise sources. For example, a particular design of components in an HVAC system may be laid out to minimize noise, such as by placing noise generating equipment in locations where the impact of noise and vibrations is minimized for the occupants of the closed space.

In particular, it is known that the return air inlet is a source of noise transmission into the occupied closed spaces conditioned by an air handler. This noise coupling occurs because of physical proximity of noise sources, as noted above, in the fan unit to the inlet register at the return duct, and because of direct open air coupling within the return duct, which can be exacerbated by a straight line-of-sight return duct conduit to the blower motor, even though the return air flow occurs in a reverse direction to the noise transmission.

Accordingly, one known means to accomplish noise reduction in an air handler is to use one or more silencer elements within the return air duct conduit. Such silencers typically extend along the available line-of-sight in order to effectively attenuate resonant wavelengths related to the straight length of the conduit. Another known means to accomplish noise reduction in an air handler is to introduce an elbow joint in the return air duct conduit that eliminates the line-of-sight arrangement and reduces noise coupling as a result.

BRIEF SUMMARY

The terms "invention," "the invention," "this invention" and "the present invention" used in this patent are intended to refer broadly to all of the subject matter of this patent and the patent claims below. Statements containing these terms should be understood not to limit the subject matter described therein or to limit the meaning or scope of the patent claims below. Embodiments of the invention covered by this patent are defined by the below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

An embodiment of the present invention relates to an apparatus for reducing sound levels in an HVAC system, the apparatus including a housing configured to be positioned within an air inlet vent for an HVAC system. The housing includes a first opening configured to intake air and a second opening configured to output air and a plurality of baffles positioned within said housing, each baffle including a body defining a volume and has a plurality of perforations, wherein each baffle is affixed to the housing and wherein the plurality of perforations are configured to allow airflow through the volume of the body and redirecting sound waves.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

Figure 1:
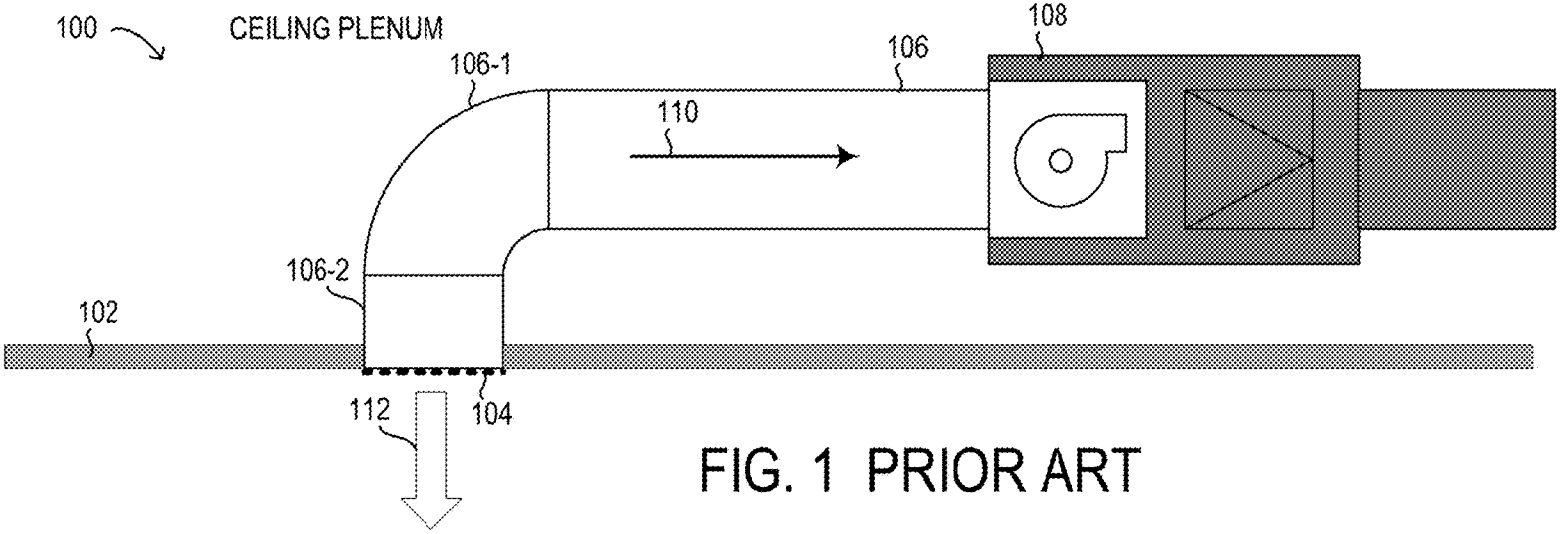
FIG. 1 PRIOR ART
FIG. 1 is a prior art depiction of a ceiling plenum with an air handler.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Throughout this disclosure, a hyphenated form of a reference numeral refers to a specific instance of an element and the un-hyphenated form of the reference numeral refers to the element generically or collectively. Thus, as an example (not shown in the drawings), device "12-1" refers to an instance of a device class, which may be referred to collectively as devices "12" and any one of which may be referred to generically as a device "12". In the figures and the description, like numerals are intended to represent like elements.

As noted above, conventional means for noise attenuation within a return air duct conduit have included long line-of-sight silencers that require a relatively large space, which is undesirable. The use of elbow joints is another means for noise attenuation within a return air duct conduit. However, a simple elbow joint may be limited in the noise attenuation attained and may perform more poorly at noise attenuation that a line-of-sight silencer that works over longer attenuation distances.

As disclosed herein, a compact air plenum silencer may be used in place of an elbow joint in a return air duct conduit for noise attenuation. The compact air plenum silencer disclosed herein may enable noise attenuation by providing a 90 degree pathway for air flow and noise coupling in the return air duct conduit. The compact air plenum silencer disclosed herein may incorporate a plurality of internal baffle elements that induce internal reflection of incident sound waves, resulting in longer acoustical pathways as the incident sound traverses through the silencer. The longer acoustical pathways increase an attenuation time, and thus, dampening of the sound waves traversing through the silencer. In this manner, the compact air plenum silencer disclosed herein may provide a high degree of sound attenuation within a compact volume, which is desirable. Accordingly, the compact air plenum silencer disclosed herein may be particularly well suited for applications in which available space for air handling equipment is constrained, such as by available volume or cost per unit of volume.

Some approaches to noise reduction in HVAC systems have been disclosed in U.S. Pat. Nos. 10,309,302 B2 and 8,087,492 B2, which are incorporated by reference herein.

Referring now to the drawings, FIG. 1 is a prior art depiction of a ceiling plenum 100 that may be present in a typical building as free space above a ceiling 102 of a room. It is noted that FIG. 1 is a schematic illustration and is not necessarily drawn to scale or perspective. In ceiling plenum 100, a return air conduit 106 is in fluid communication with an air handler 108. Return air conduit 106 terminates at an opposing end with a return air duct 106-2 that is shown covered with a grille 104 to draw in return air and to enable the return air to be provided to air handler 108 in a direction given by arrow 110. As shown, return air conduit 106 also includes an elbow joint 106-1 in fluid communication with return air duct 106-2 that is open and serves to redirect the return air that may be drawn in upwards (vertically) from return air duct 106-2 and redirected towards air handler 108 in horizontal direction 110. Furthermore, noise emanating from air handler 108, may propagate from various components included in air handler 108, which may be different in particular embodiments, along return air conduit 106 in a direction opposite to arrow 110. The noise may be attenuated by elbow joint 106-1 to a degree and may emerge into the room at grille 104, in a direction and relative magnitude given by arrow 112, which is undesirable. For example, elbow joint 106-1 may attenuate the noise by reflecting some noise power back towards air handler 108 within return air conduit 106. However, a magnitude of noise introduced into the room below ceiling 102, as given by arrow 112, may still be larger than desired. In some implementations, a volume available for line-of-sight silencing equipment in ceiling plenum 100 may be constrained, such as by a limited space available for return air conduit 106, for example.

Figure 2:
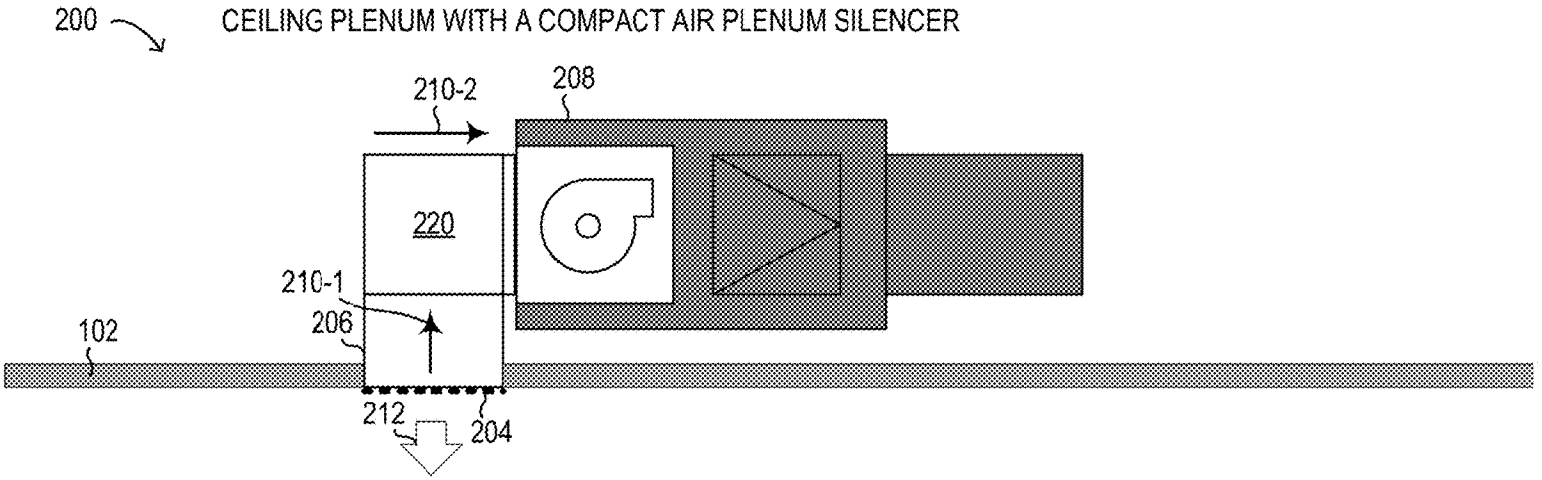
FIG. 2 is a depiction of a ceiling plenum with a compact air plenum silencer.

In FIG. 2, a ceiling plenum 200 with a compact air plenum silencer 220, as disclosed herein, is depicted. It is noted that FIG. 2 is a schematic illustration and is not necessarily drawn to scale or perspective. In ceiling plenum 200, an air handler 208 includes, among other elements, a return air duct 206 that is in fluid communication with air handler 208 via compact air plenum silencer 220, to enable return air to be provided to air handler 208 in a direction given by arrow 210-2. Return air duct 206 is shown covered by a grille 204 at an interior surface of ceiling 102. As shown, compact air plenum silencer 220 may include various internal baffle elements, as will be described in further detail herein. As shown, compact air plenum silencer 220 also provides the 90-degree redirection functionality for return air (not shown or visible), which may be drawn into compact air plenum silencer 220 vertically, as given by arrow 210-1 and may emerge horizontally, as given by arrow 210-2. Furthermore, noise emanating from air handler 208, as described previously, may be coupled to compact air plenum silencer 220 in a direction opposite to arrow 210-2 and may pass through compact air plenum silencer 220, where the noise may be attenuated to a large degree. Accordingly, a direction and relative magnitude of the noise emitted from compact air plenum silencer 220 at grille 204 into the room below ceiling 102 is given by an arrow 212, which is shown smaller in magnitude than arrow 112 in prior art FIG. 1. The difference in magnitude between prior art arrow 112 and arrow 212 of compact air plenum silencer 220 may indicate that greater noise attenuation occurs with compact air plenum silencer 220 than with the operation of elbow joint 106-1 and conduit 106, for the same or comparable conditions.

It is noted that ceiling plenums 100 and 200, respectively shown in FIGS. 1 and 2, are exemplary embodiments for descriptive purposes and do not limit any application of compact air plenum silencer 220 to a particular arrangement or HVAC system design. For example, in various embodiments, compact air plenum silencer 220 may be used in different portions of a building or HVAC system, such as within a floor plenum below a floor, instead of within ceiling plenum 200 as depicted.

It is further noted that in some implementations, ceiling 102 may not be present and noise from air handler 108 may be directly coupled into an occupied space below air handler 108. In various environments, a direction of return air flow given by a spatial orientation of grille 204 and return air duct 206 may vary from the vertical orientation of arrow 210-1 shown in FIG. 2. For example, when ceiling 102 is not present, return may be drawn in vertically downwards or horizontally or at an angle to vertical/horizontal. In some instances, return air duct 206 and grille 204 may be oriented or arranged or routed to avoid a physical barrier to the return air flow that may otherwise obstruct the return air. Because of the compact arrangement enabled by compact air plenum silencer 220, as shown in FIG. 2, various such orientations and arrangements can be enabled, as desired, in order to minimize or optimize the space occupied by air handler 208.

Figure 3:
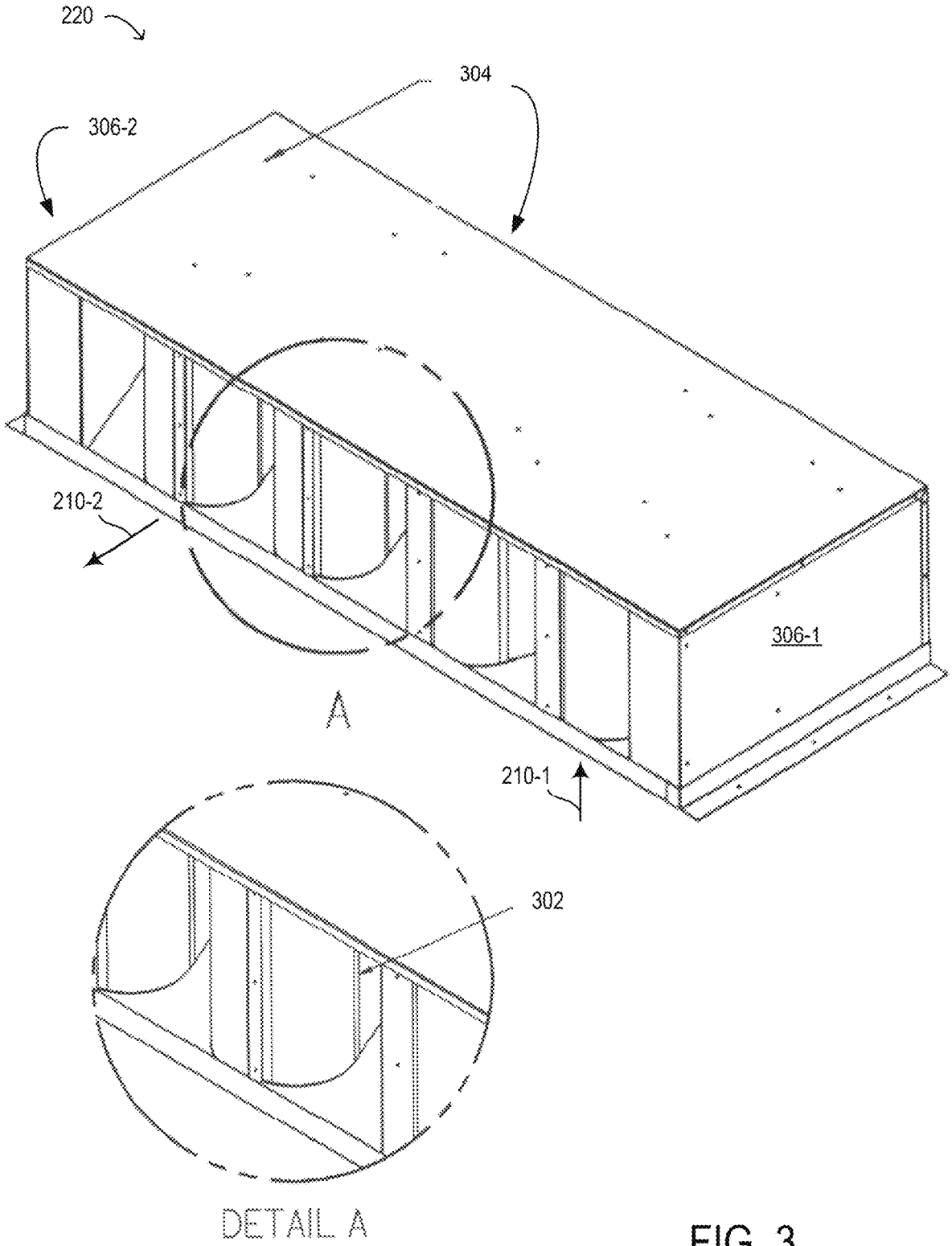
FIG. 3 is a depiction of a compact air plenum silencer in a perspective view.

Referring now to FIG. 3, a perspective and detail view of compact air plenum silencer 220 is depicted. It is noted that FIG. 3 is a schematic illustration and is not necessarily drawn to scale or perspective. As shown in FIG. 3, compact air plenum silencer 220 is fabricated in the form of a rectangular prism that may be physically dimensioned to correspond to any cross-sectional air inlet area for fluid communication with air handler 208, as shown in FIG. 2. In some embodiments, the air plenum silencer 220 further includes a housing configured to contain the components of the air plenum silencer 220. Said housing is positioned within the air inlet and dimensioned to correspond with the cross-sectional area of the air inlet and includes a first opening configured to intake air and a second opening configured to output air. In FIG. 3, a cover 304 of compact air plenum silencer 220 is visible at a top surface and also encloses a rear surface that is obscured from view. Also visible is a first side cover 306-1 of compact air plenum silencer 220 that encloses a first side, while a second side cover 306-2 that encloses a second side of compact air plenum silencer 220 is obscured from the perspective view. In FIG. 3, arrow 210-1 shows an air intake direction of compact air plenum silencer 220 that occurs via a bottom opening (not visible in FIG. 3, see FIG. 5), while arrow 210-2 shows the air outlet direction, corresponding to FIG. 2, from a front opening. Also visible in FIG. 3 and in enlarged portion A are baffle elements 302 that are placed in a particular orientation, dimension, and arrangement within compact air plenum silencer 220. As shown in FIGS. 3-6, baffle elements 302 may be affixed to the housing and may further define a volume using an empty body, and, in some embodiments, said volume is filled with sound-attenuating media within compact air plenum silencer 220. For example, the sound-attenuating media may be a porous material, like fiberglass, or a non-porous material, in particular applications with an elastic-type surface. In some cases, air spacer elements may be used to created internal compartments within baffle elements 302 that can dampen sound energy. The baffle elements 302 may additionally be perforated, for example at the bottom opening, as to allow airflow through the volume of the body of the baffle 302 attenuating sound waves.

The open area of the perforation may range from about 13% to about 51% in various embodiments. The particular orientation, dimension, and arrangement of baffle elements 302 within compact air plenum silencer 220, as will be described in further detail herein, may enable compact air plenum silencer 220 to attenuate noise that is incident at the front opening. The range of 13% to about 51% is merely exemplary and additional ranges between 10% and 60% are envisioned within the scope of the present disclosure.

Figure 4:
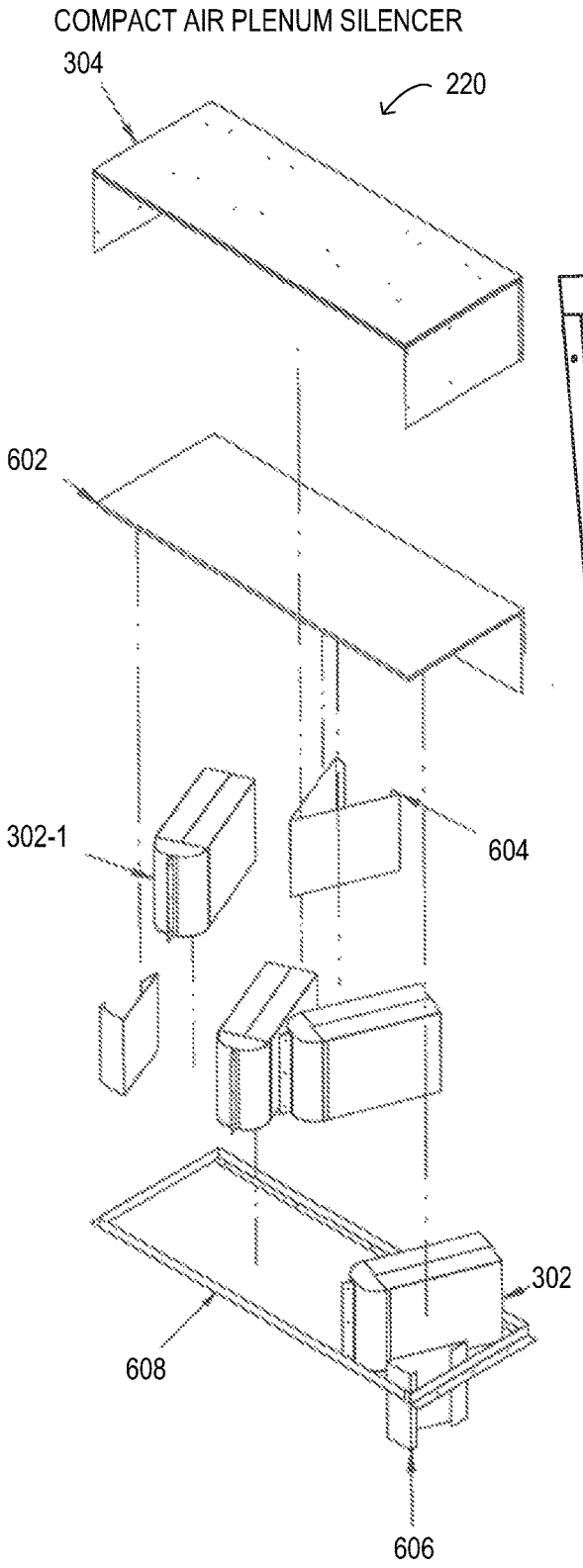
FIG. 4 is a depiction of a compact air plenum silencer in an exploded view.
Figure 6:
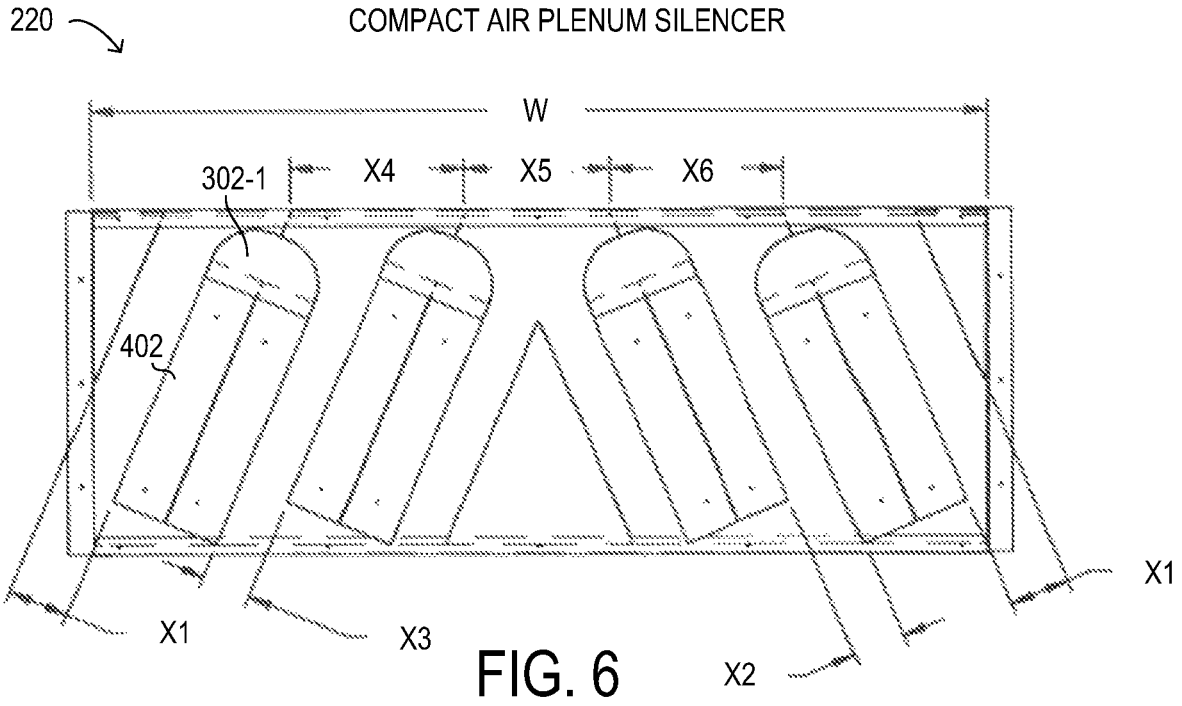
FIG. 6 is a depiction of a compact air plenum silencer in a bottom view.

Referring now to FIG. 4, an exploded view of compact air plenum silencer 220 is depicted. It is noted that FIG. 4 is a schematic illustration and is not necessarily drawn to scale or perspective. As shown in FIG. 4, various internal elements of compact air plenum silencer 220 are now visible. Under cover 304 and side covers 306, an insulation layer 602 insulates the top and rear faces of compact air plenum silencer 220. As shown in the example of FIG. 4, within compact air plenum silencer 220, four (4) baffle elements 302 are visible. However, it is noted that different numbers of baffle elements may be used in different embodiments, for example, depending on a width of compact air plenum silencer 220. Each baffle element 302 is shaped as a rectangular prism body and may be perforated at one or more of its sides to facilitate air flow, while also serving to reflect acoustical waves. As shown, each baffle element includes a nosepiece 302-1 that is closed and that faces the front opening where return air emerges from compact air plenum silencer 220. Also shown in FIG. 4 is a frame 608 that provides the inlet opening for compact air plenum silencer 220 and which supports baffle elements 302 internally within compact air plenum silencer 220. Also visible in FIG. 4 are side triangles 606 as well as center triangle 604, which may further be additional perforated elements within compact air plenum silencer 220 such as within the housing. In some embodiments, the additional perforated elements may include a triangular element. As shown in FIG. 6, said triangular element may be positioned between two baffles and include a vertex formed by two sides forming a volume. Said volume may include sound-attenuating media as described above to further attenuate sound waves. In some embodiments, the triangular element may be positioned such that the vertex is proximal the transverse axis of the housing.

Figure 5:
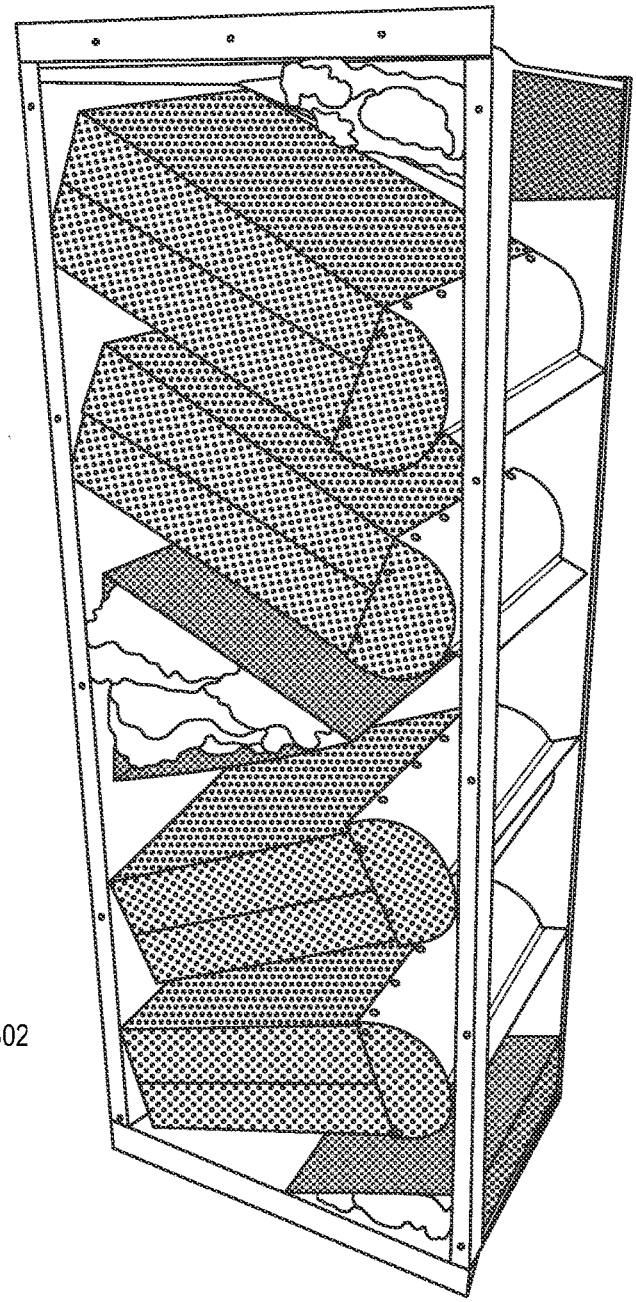
FIG. 5 is an image of a compact air plenum silencer.

In FIG. 5, an image of compact air plenum silencer 220 formed from galvanized sheet metal is shown in an orientation standing with first side cover 306-1 down. In FIG. 5, the bottom opening and frame 608 of compact air plenum silencer 220 are visible, showing the bottom perforated faces of baffle elements 302. Also visible in FIG. 5 is the front opening of compact air plenum silencer 220 and respective nosepieces 302-1 of baffle elements 302.

Referring now to FIG. 6, a bottom view of compact air plenum silencer 220 is depicted in which the placement and orientation of four (4) baffle elements 302 with respective nosepieces 302-1 are visible. In such embodiments, the housing may include a transverse axis with two of the baffles elements 302 located on a first side of the transverse axis and the remaining two baffle elements 302 located on a second side of the transverse axis. In some embodiments, it may be beneficial as to arrange the two baffles located on the first side of the transverse axis symmetrically in relation to the two baffles located on the second side of the transverse axis. It is noted that FIG. 6 is a schematic illustration and is not necessarily drawn to scale or perspective. As shown in FIG. 6, compact air plenum silencer 220 may have an internal width W. Various other dimensions between the respective baffle elements 302 are shown in FIG. 6 as dimensions X1, X2, X3, X4, X5, and X6, which may be selected for a particular performance or noise attenuation characteristics of compact air plenum silencer 220. It is noted that while compact air plenum silencer 220 is shown herein in an exemplary embodiment having 4 baffle elements 302 for descriptive clarity, in other embodiments and implementations, compact air plenum silencer 220 may be fabricated to different dimensions with different numbers of baffle elements 302. For example, the external and internal dimensions of compact air plenum silencer 220 may be selected for a given level of sound attenuation performance, or for noise damping of a given spectral portion of the acoustic noise. It is noted that the arrangement shown in FIG. 6 is merely exemplary and a variety of orientations, number of baffle elements 302, and arrangements are envisioned within the scope of this disclosure.

Specifically, in operation, compact air plenum silencer 220 may result in a differential pressure that is slightly greater than elbow joint 106-1, for example, which is internally open, but which still represents a relatively low static pressure, and may be less than about 1 inch of water gage (WG), or more particularly, less than about 0.6 inch WG. In various embodiments, an air flow rate that compact air plenum silencer 220 can support may be from about 200 cubic feet/min. (cfm) to about 2,000 cfm. In typical applications, compact air plenum silencer 220 may be used for ambient air handling in an occupied building or room, and may accordingly be typically operated at ambient temperatures of between about 60° F. and about 85° F., or more specifically between about 65° F. and about 80° F. The indoor typical operating environment of compact air plenum silencer 220 may have about 50% humidity, which may vary according to various factors within a normal range of humidity for indoor conditions, for example. Furthermore, a frequency range over which compact air plenum silencer 220 may attenuate noise may be from about 100 Hz to about 5,000 Hz, or more specifically between about 125 Hz to about 4,000 Hz and may depend upon dimensions and configuration of the silencer. In a typical ceiling plenum of a commercial building, for example, during operation with air handler 208, compact air plenum silencer 220 may result in an ambient noise level that is significantly reduced (see also Table 1).

Figure 7:
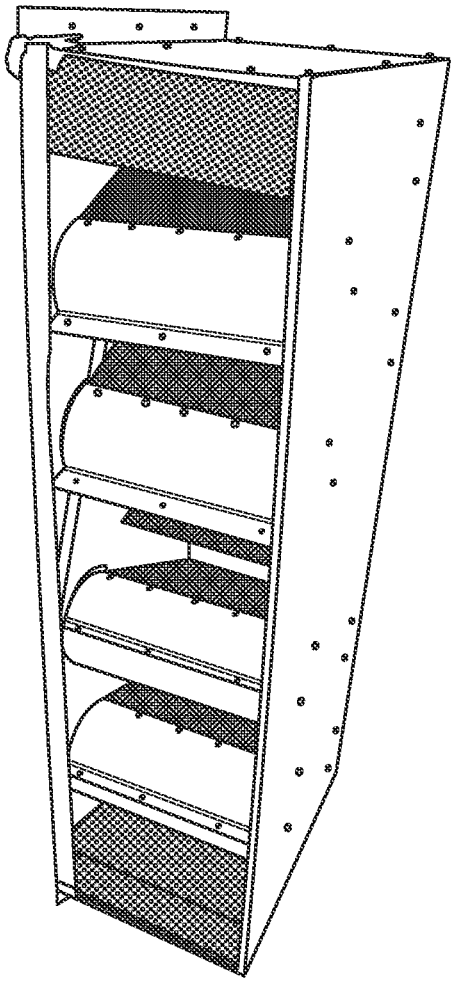
FIG. 7 is an image of a compact air plenum silencer.

In FIG. 7, an image of compact air plenum silencer 220 formed from galvanized sheet metal is shown in an orientation standing with first side cover 306-1 down. In FIG. 7, the bottom opening and top surface of cover 304 are visible, along with the front opening and respective nosepieces 302-1 of baffle elements 302 of compact air plenum silencer 220.

Figure 8B:
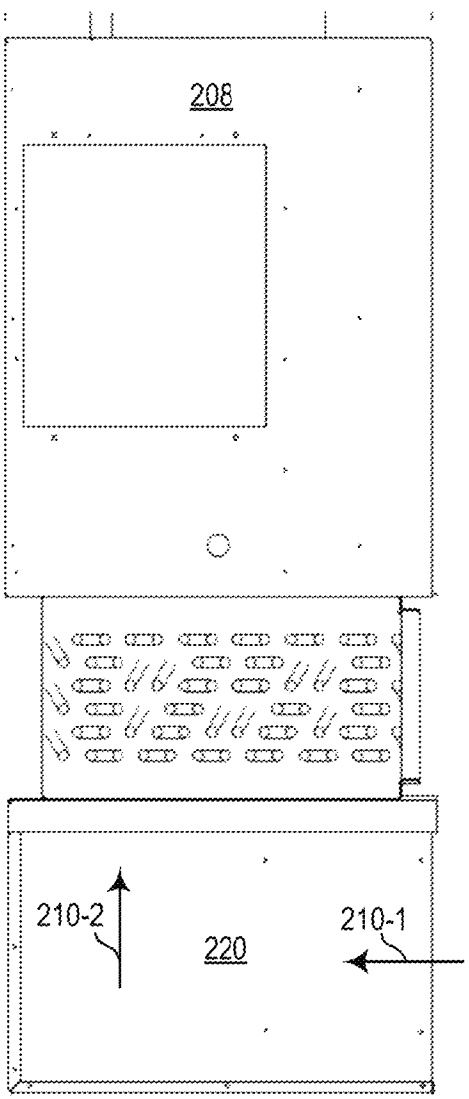
FIGS. 8A and 8B are depictions of a compact air plenum silencer.
Figure 8A:
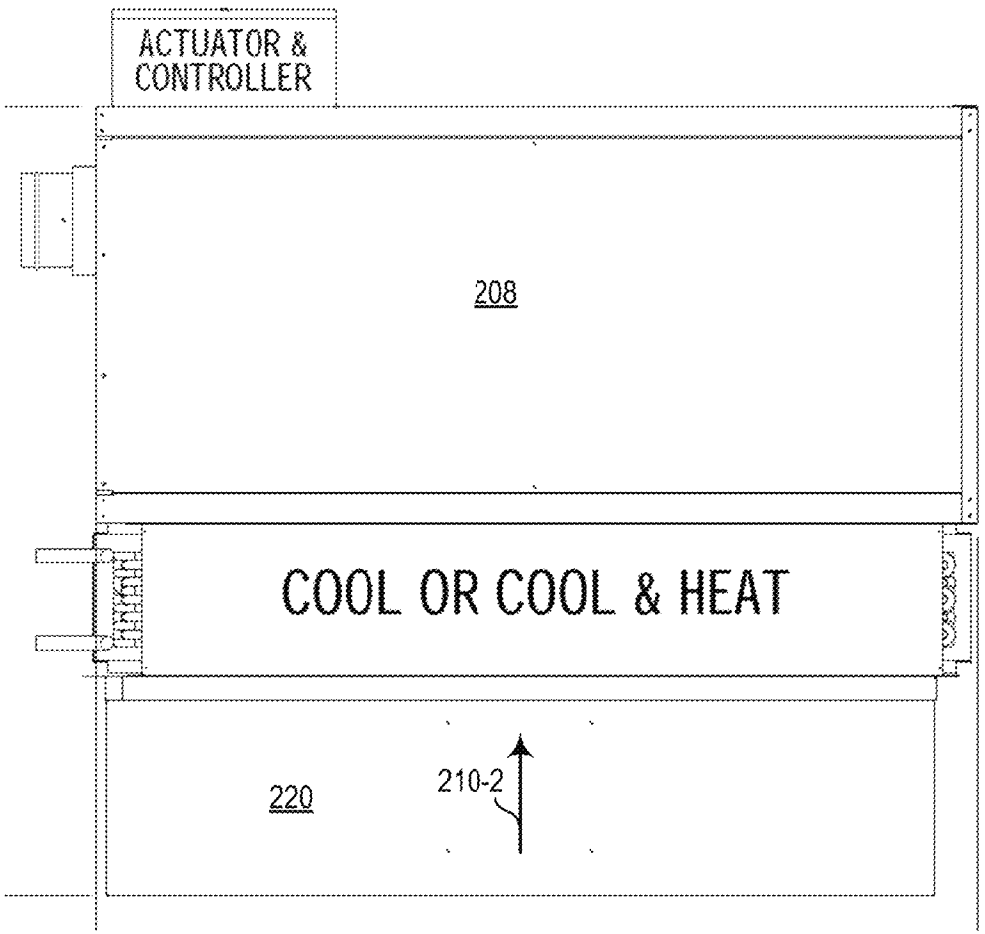

In FIGS. 8A and 8B a top view and a side view, respectively, of air handler 208 attached to compact air plenum silencer 220 in one embodiment is depicted. In FIGS. 8A and 8B, air handler 208 is equipped with a heating/cooling heat exchange unit for conditioning the return air flow, shown by arrows 210.

Figure 9B:
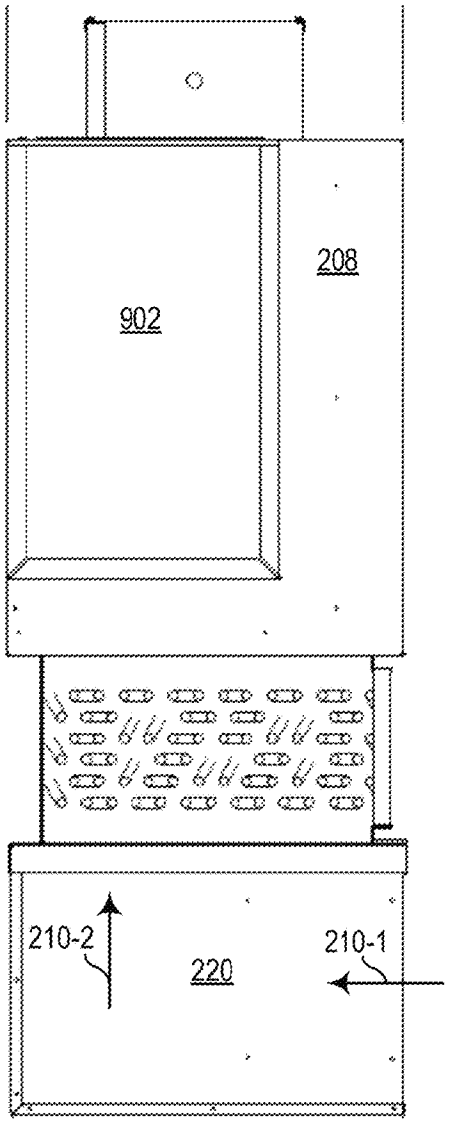
FIGS. 9A and 9B are depictions of a compact air plenum silencer.
Figure 9A:
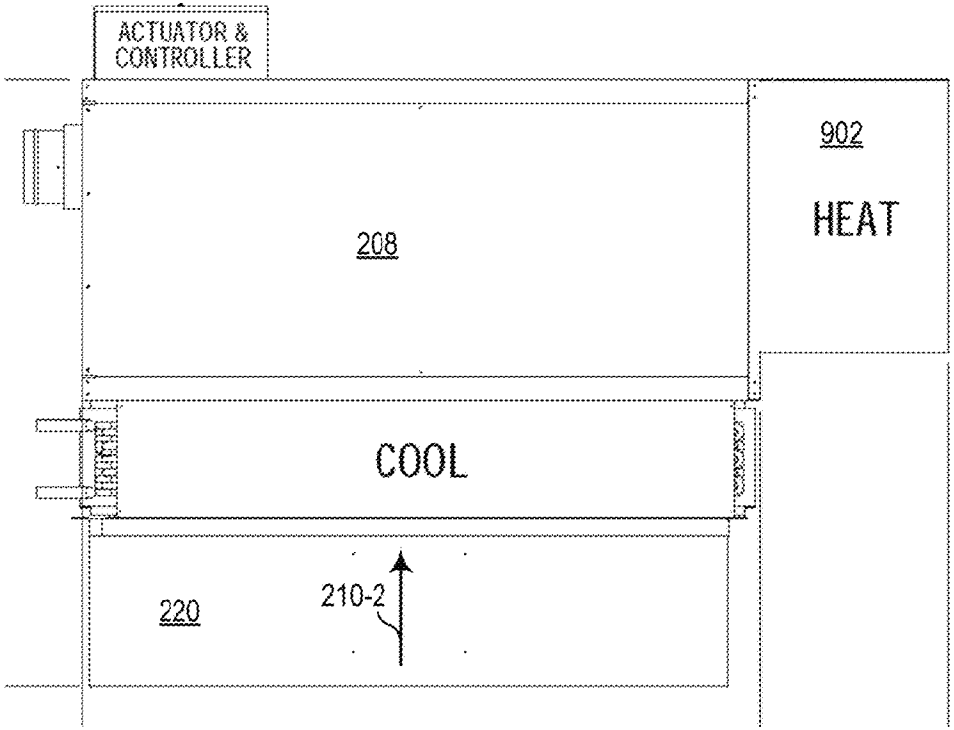

In FIGS. 9A and 9B a top view and a side view, respectively, of air handler 208 attached to compact air plenum silencer 220 in one embodiment is depicted. In FIGS. 9A and 9B, air handler 208 is equipped with a cooling coil for conditioning the return air flow (heat exchange unit), as shown by arrows 210, and also includes a heating element that is mounted at one side, which may be used to heat supply air flow (not shown).

In Table 1 below, an amount of noise reduction in dB that compact air plenum silencer 220 may provide is given for 6 different octave bands versus fan airflow rates, in one exemplary embodiment. The measurements in Table 1 were obtained by measurement of sound levels in 6 octave bands radiated from the unit with and without the silencer attached. The measurements were taken in a reverberation chamber designed for such measurements and recorded in ⅓ octave bands and mathematically combined into full octave bands as required by the applicable standards for measuring air terminal units, such as ANSI/ASHRAE Standard 130-2016 for example. In particular, the values in Table 1 may indicate that attenuation performance of compact air plenum silencer 220 may improve with increasing sound levels.

TABLE 1

Noise reduction in decibels for different fan airflow rates and octave bands.

| Fan Airflow [cfm] | Octave 2 (125 Hz) | Octave 3 (250 Hz) | Octave 4 (500 Hz) | Octave 5 (1,000 Hz) | Octave 6 (2,000 Hz) | Octave 7 (4,000 Hz) |
|---|---|---|---|---|---|---|
| 550 | 3 | 5 | 6 | 3 | 5 | 3 |
| 800 | 3 | 5 | 6 | 5 | 7 | 6 |
| 1,200 | 2 | 6 | 7 | 5 | 8 | 8 |
| 1,600 | 2 | 6 | 7 | 6 | 9 | 11 |
| 2,000 | 2 | 6 | 7 | 6 | 9 | 11 |

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

EXAMPLES

A collection of exemplary embodiments, including at least some explicitly enumerates as "Examples" providing additional description of a variety of example types in accordance with the concepts described herein are provided below. These examples are not meant to be mutually exclusive exhaustive, or restrictive; and the invention is not limited to these examples but rather encompasses all possible modifications and variations within the scope of the issued claims and their equivalents.

Example 1. A sound reducing system for returning air to an air handler in an HVAC system, the sound reducing system including an air inlet having a cross-sectional area and in fluid communication with an air handler; a housing configured to be positioned within the air inlet and dimensioned to correspond with the cross-sectional area of the air inlet, wherein the housing includes a first opening configured to intake air and a second opening configured to output air; and a plurality of baffles positioned within the housing, each baffle including: a body defining a volume and having a plurality of perforations positioned thereon and facing the first opening, wherein each baffle is affixed to the housing, and wherein a sound-attenuating media is positioned within the volume; and wherein the plurality of perforations are configured to allow airflow through the volume of the body of the baffle while attenuating sound waves, and wherein the housing has a transverse axis and at least two baffles of the plurality of baffles are located on a first side of the transverse axis and at least two baffles of the plurality of baffles are located on a second side of the transverse axis.

Example 2. The sound reducing system of any of the preceding or subsequent examples or combination of examples, wherein the housing further includes a cover which covers a top face, a rear face, a first side, and a second side of the housing.

Example 3. The sound reducing system of any of the preceding or subsequent examples or combination of examples, further including an insulation layer positioned at the top face and the rear face.

Example 4. The sound reducing system of any of the preceding or subsequent examples or combination of examples, wherein the at least two baffles located on the first side of the transverse axis are arranged symmetrically to the at least two baffles located on the second side of the transverse axis with respect to the transverse axis of the housing.

Example 5. The sound reducing system of any of the preceding or subsequent examples or combination of examples, wherein the plurality of perforations of each baffle comprises an open area between 10% and 60% of a surface area of a side of the baffle having the plurality of perforations.

Example 6. An apparatus for reducing sound levels in an HVAC system, the apparatus including: a housing configured to be positioned within an air inlet vent for an HVAC system, wherein the housing includes a first opening configured to intake air and a second opening configured to output air; and a plurality of baffles positioned within said housing, wherein each baffle includes a body defining a volume and has a plurality of perforations; wherein each baffle is affixed to the housing; wherein the plurality of perforations are configured to allow airflow through the volume of the body and redirecting sound waves.

Example 7. The apparatus of any of the preceding or subsequent examples or combination of examples, wherein the volume of the body of each baffle comprises a sound-attenuating media.

Example 8. The apparatus of any of the preceding or subsequent examples or combination of examples, wherein the housing is dimensioned so as to correspond with a cross-sectional area of the air inlet.

Example 9. The apparatus of any of the preceding or subsequent examples or combination of examples, wherein the apparatus comprises at least four baffles.

Example 10. The apparatus of any of the preceding or subsequent examples or combination of examples, wherein the housing has a transverse axis and at least two baffles are located on a first side of the transverse axis and at least two baffles are located on a second side of the transverse axis.

Example 11. The apparatus of any of the preceding or subsequent examples or combination of examples, wherein the four baffles are arranged symmetrically with respect to the transverse axis of the housing.

Example 12. The apparatus of any of the preceding or subsequent examples or combination of examples, further including a plurality of additional perforated elements positioned within the housing.

Example 13. The apparatus of any of the preceding or subsequent examples or combination of examples, wherein at least one of the plurality of additional perforated elements comprises at least one triangular element.

Example 14. The apparatus of any of the preceding or subsequent examples or combination of examples, wherein the triangular element comprises a vertex formed by two sides and the vertex is proximal the transverse axis of the housing and is located between two of the baffles.

Example 15. The apparatus of any of the preceding or subsequent examples or combination of examples, wherein the triangular element further defines a volume, wherein the volume comprises a sound-attenuating media.

Example 16. The apparatus of any of the preceding or subsequent examples or combination of examples, wherein the body of each baffle comprises a rectangular prism shape.

Example 17. The apparatus of any of the preceding or subsequent examples or combination of examples, wherein each baffle additionally includes a nosepiece positioned proximal the second opening of the housing.

Example 18. The apparatus of any of the preceding or subsequent examples or combination of examples, wherein the plurality of perforations of each baffle comprises an open area between 10% and 60% of a surface area of a side of the baffle having the plurality of perforations.

Example 19. The apparatus of any of the preceding or subsequent examples or combination of examples, wherein the housing further includes a top face, a rear face, a first side, and a second side.

Example 20. The apparatus of any of the preceding or subsequent examples or combination of examples, wherein the housing further includes a cover which covers the top face, the rear face, the first side, and the second side.

Example 21. The apparatus of any of the preceding or subsequent examples or combination of examples, further including an insulation layer positioned at the top face and the rear face.

Example 22. The apparatus of any of the preceding or subsequent examples or combination of examples, wherein the housing further includes a frame positioned proximal the first opening, the frame configured to support the plurality of baffles.

Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

Although certain exemplary embodiments of the disclosure have been shown and described in detail, it should be understood that various changes and modifications may be made therein without departing from the scope of the appended claims. Unless defined otherwise, all technical and scientific terms used herein have the same meaning as commonly understood by one of ordinary skill in the art to which this invention belongs.

It must be noted that as used herein and in the appended claims, the singular forms "a," "an," and "the" include plural referents unless the context clearly dictates otherwise. Although the terms "first," "second," etc., may be used herein to describe various elements, components, regions, layers and/or sections, it should be understood that they should not be limited by these terms. These terms are used only to distinguish one element, component, region, layer, or section from another region, layer, or section. Thus, a first element, component, region, layer, or section discussed above could be termed a second element, component, region, layer, or section without departing from the teachings of the present invention.

What is claimed is:

1. A sound reducing system for returning air to an air handler in an HVAC system, the sound reducing system comprising:

an air inlet having a cross-sectional area and in fluid communication with an air handler;

a housing in fluid communication with the air inlet and dimensioned to correspond with the cross-sectional area of the air inlet, wherein the housing includes a first opening configured to intake air and a second opening configured to output air, wherein the first opening is orthogonal to the second opening; and a plurality of baffles positioned within the housing, each baffle including:

a body defining a volume and having a plurality of perforations positioned thereon and facing the first opening, wherein each baffle is affixed to the housing, and wherein a sound-attenuating media is positioned within the volume; and wherein the plurality of perforations are configured to allow airflow through the volume of the body of the baffle while attenuating sound waves, wherein the housing has a transverse axis and at least two baffles of the plurality of baffles are located on a first side of the transverse axis and at least two baffles of the plurality of baffles are located on a second side of the transverse axis, and wherein the housing further includes at least a first cover which covers a first surface orthogonal to a rear surface, a first side, and a second side of the housing.

2. The system of claim 1, further comprising an insulation layer positioned at the first surface and the rear surface.

3. The system of claim 1, wherein the at least two baffles located on the first side of the transverse axis are arranged symmetrically to the at least two baffles located on the second side of the transverse axis with respect to the transverse axis of the housing.

4. The system of claim 1, wherein the plurality of perforations of each baffle comprises an open area between 10% and 60% of a surface area of a side of the baffle having the plurality of perforations.

5. An apparatus for reducing sound levels in an HVAC system, the apparatus comprising:

a housing in fluid communication with an air inlet vent for an HVAC system, wherein the housing includes a first opening configured to intake air and a second opening configured to output air, wherein the first opening is orthogonal to the second opening; and a plurality of baffles positioned within said housing, wherein each baffle includes a body defining a volume and has a plurality of perforations facing the first opening;

wherein each baffle is affixed to the housing;

wherein the plurality of perforations are configured to allow airflow through the volume of the body and redirecting sound waves, and wherein the housing further includes at least a first cover which covers a first surface orthogonal to a rear surface, a first side, and a second side of the housing.

6. The apparatus of claim 5, wherein the volume of the body of each baffle comprises a sound-attenuating media.

7. The apparatus of claim 5, wherein the housing is dimensioned so as to correspond with a cross-sectional area of the air inlet.

8. The apparatus of claim 5, wherein the apparatus comprises at least four baffles.

9. The apparatus of claim 8, wherein the housing has a transverse axis and at least two baffles are located on a first side of the transverse axis and at least two baffles are located on a second side of the transverse axis.

10. The apparatus of claim 9, wherein the four baffles are arranged symmetrically with respect to the transverse axis of the housing.

11. The apparatus of claim 9, further comprising a plurality of additional perforated elements positioned within the housing.

12. The apparatus of claim 11, wherein at least one of the plurality of additional perforated elements comprises at least one triangular element.

13. The apparatus of claim 12, wherein the triangular element comprises a vertex formed by two sides and the vertex is proximal the transverse axis of the housing and is located between two of the baffles.

14. The apparatus of claim 12, wherein the triangular element further defines a volume, wherein the volume comprises a sound-attenuating media.

15. The apparatus of claim 5, wherein the body of each baffle comprises a rectangular prism shape.

16. The apparatus of claim 5, wherein each baffle additionally includes a nosepiece positioned proximal the second opening of the housing.

17. The apparatus of claim 5, wherein the plurality of perforations of each baffle comprises an open area between 10% and 60% of a surface area of a side of the baffle having the plurality of perforations.

18. The apparatus of claim 5, further comprising an insulation layer positioned at the first surface and the rear surface.

19. The apparatus of claim 5, wherein the housing further includes a frame positioned proximal the first opening, the frame configured to support the plurality of baffles.

* * * * *